US009596885B2

(12) United States Patent
Liu

(10) Patent No.: US 9,596,885 B2
(45) Date of Patent: Mar. 21, 2017

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 655 days.

(21) Appl. No.: 14/055,288

(22) Filed: Oct. 16, 2013

(65) Prior Publication Data

US 2015/0059783 A1 Mar. 5, 2015

(30) Foreign Application Priority Data

Aug. 29, 2013 (CN) ..... 2013 2 0534043 U

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2008/0094028 A1* 4/2008 Yang ..... H02J 7/0045 320/114
2014/0123990 A1* 5/2014 Timmermans ..... A24F 47/008 131/328
2014/0261492 A1* 9/2014 Kane ..... A24F 47/008 131/328
2014/0299137 A1* 10/2014 Kieckbusch ..... A24F 47/008 131/328
2014/0373857 A1* 12/2014 Steinberg ..... A24F 47/008 131/329

FOREIGN PATENT DOCUMENTS

CN 201900065 U * 7/2011 ..... A24F 47/008

OTHER PUBLICATIONS

CN 201900065 Translation; Jul. 2011; Gongyun Long.*

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

An electronic cigarette is provided, which comprises a battery assembly with a battery built in, an atomizer assembly, a circuit board for controlling the battery assembly to power the atomizer assembly, and a press-key switch installed on the circuit board. A first electrical connection fixing spot is provided on the circuit board and is electrically connected to the press-key switch. The first electrical connection fixing spot is fixed with a first elastic structure, and the first elastic structure elastically abuts against a first electrode of the battery. The following beneficial effects will be achieved when implementing the present application. In the electronic cigarette, a first electrical connection fixing spot in the circuit board elastically abuts against a first electrode of the battery via a first elastic structure. Therefore, the assembling operation for the electronic cigarette is convenient, and thus benefiting for the automated assembling production.

2 Claims, 8 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320534043.9 filed in P.R. China on Aug. 29, 2013, the entire contents of which are hereby incorporated by reference.

FIELD OF THE INVENTION

The present application relates to the field of daily electronic products, and more particularly, relates to an electronic cigarette.

BACKGROUND OF THE INVENTION

The electronic cigarette is mainly used for a user to give up smoking and replace the cigarette. The traditional electronic cigarette comprises a battery assembly, an atomizer assembly, a circuit board for controlling the battery assembly to power the atomizer assembly, and a press-key switch installed on the circuit board to trigger the operation of the circuit board. The circuit board usually is electrically connected to the battery assembly via soldered wires. However, when using the soldered wires, it is inconvenient to hackle the wires and the assembling process is miscellaneous and complicated, which leads to a low productive efficiency.

SUMMARY OF THE INVENTION

The object of the present application is to provide an electronic cigarette, which is convenient in assembling the circuit board and the battery assembly, aiming at the drawbacks that the connection between the circuit board and the battery assembly in the traditional electronic cigarette is complicated in the prior art.

The technical schemes to solve the above technical problems are as follows.

In one aspect, an electronic cigarette is provided, which comprises a battery assembly with a battery built in, an atomizer assembly, a circuit board for controlling the battery assembly to power the atomizer assembly, and a press-key switch installed on the circuit board.

In the aspect, the battery assembly comprises a battery sleeve, the battery installed in the battery sleeve, and a first electrode connector and a second electrode connector which are installed on one end of the battery sleeve. The circuit board is installed in the battery sleeve and located between the battery and the second electrode connector. The first electrode connector is electrically connected to a second electrode of the battery.

A first electrical connection fixing spot is provided on the circuit board and is electrically connected to the press-key switch. The first electrical connection fixing spot is fixed with a first elastic structure, and the first elastic structure elastically abuts against a first electrode of the battery.

A second electrical connection fixing spot is provided on the circuit board and is electrically connected to the press-key switch. The second electrical connection fixing spot is fixed with a second elastic structure, and the second elastic structure elastically abuts against the second electrode connector.

A third electrical connection fixing spot is provided on the circuit board and is electrically connected to the press-key switch. A switch indicating lamp is connected between the press-key switch and the third electrical connection fixing spot in series. The third electrical connection fixing spot is fixed with a third elastic structure, and the third elastic structure elastically abuts against the inner wall of the battery sleeve. The inner wall of the battery sleeve is electrically connected to the second electrode of the battery.

In one embodiment, the first elastic structure is a first elastic piece. The first elastic piece comprises a first fix portion inserted in the first electrical connection fixing spot and a first elastic portion extending from the first fix portion towards the battery. The first elastic portion abuts against the first electrode mutually.

In the embodiment, the second elastic structure is a second spring. One end of the second spring is electrically connected to the second electrical connection fixing spot, and the other end of the second spring abuts against the second electrode connector mutually.

In the embodiment, the third elastic structure is a third elastic piece. The third elastic piece comprises a third fix portion inserted in the third electrical connection fixing spot, and a third elastic portion extending from the third fix portion towards the inner wall of the battery sleeve. The third elastic portion abuts against the inner wall of the battery sleeve mutually.

In another embodiment, the first elastic structure is a first telescopic device. The first telescopic device comprises a first mount base installed at the first electrical connection fixing spot, a first telescopic bar settled in the first mount base in a telescopic way, and a first elastic member that is elastically supported between the first mount base and the first telescopic bar. The first telescopic bar abuts against the first electrode mutually.

In the embodiment, the second elastic structure is a second telescopic device. The second telescopic device comprises a second mount base installed at the second electrical connection fixing spot, a second telescopic bar settled in the second mount base in a telescopic way, and a second elastic member that is elastically supported between the second mount base and the second telescopic bar. The second telescopic bar abuts against the second electrode connector mutually.

In the embodiment, the third elastic structure is a third telescopic device. The third flexible device comprises a third mount base installed at the third electrical connection fixing spot, a third telescopic bar settled in the third mount base in a telescopic way, and a third elastic member that is elastically supported between the third mount base and the third telescopic bar. The third flexible bar abuts against the inner wall of the battery sleeve mutually.

In a further embodiment, the first elastic structure is a first spring. One end of the first spring is electrically connected to the first electrical connection fixing spot, and the other end of the first spring abuts against the first electrode mutually. The second elastic structure is the second spring described above. The third elastic structure is the third telescopic device described above.

In other embodiment, the second elastic structure is a second elastic piece. The second elastic piece comprises a second fix portion inserted in the second electrical connection fixing spot and a second elastic portion extending from the second fix portion towards the second electrode connector. The second elastic portion abuts against the second electrode connector mutually.

In the embodiment, the third elastic structure is a third spring. One end of the third spring is electrically connected to the third electrical connection fixing spot, and the other end of the third spring abuts against the inner wall of the battery sleeve mutually.

In the aspect, the battery assembly further comprises an end cap and a elastic member. The end cap is mounted on one end of the battery sleeve, wherein the end of the battery sleeve is away from the first electrode connector. The elastic member elastically abuts between the second electrode and the end cap. The second electrode is electrically connected to the inner wall of the battery sleeve via the elastic member and the end cap successively.

In the aspect, the atomizer assembly is installed on the battery assembly in a detachable way or both are formed as an integral The following beneficial effects will be achieved when implementing the electronic cigarette of the present application. In the electronic cigarette, a first electrical connection fixing spot in the circuit board elastically abuts a first electrode of the battery via a first elastic structure. Therefore, the assembling operation for the electronic cigarette is simple and convenient, and thus benefiting for the automated assembling production.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

Figure 1:
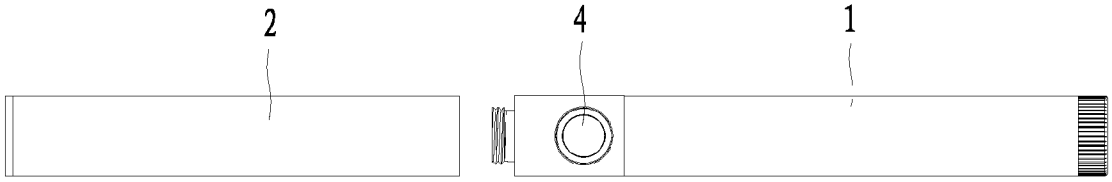
FIG. 1 is a break-up structure diagram of an electronic cigarette in a first preferred embodiment of the present application.

To make the objects, technical schemes and advantages more clearly, the present application may be further described in detail with reference to the accompanying drawings and embodiments.

Referring to FIGS. 1, 2, 4 and 5, a first preferred embodiment of an electronic cigarette is provided. The electronic cigarette comprises a battery assembly 1, an atomizer assembly 2, a circuit board 3, a press-key switch 4, a first elastic structure 5, a second elastic structure 6, a third elastic structure 7 and a switch indicating lamp 8.

Figure 2:
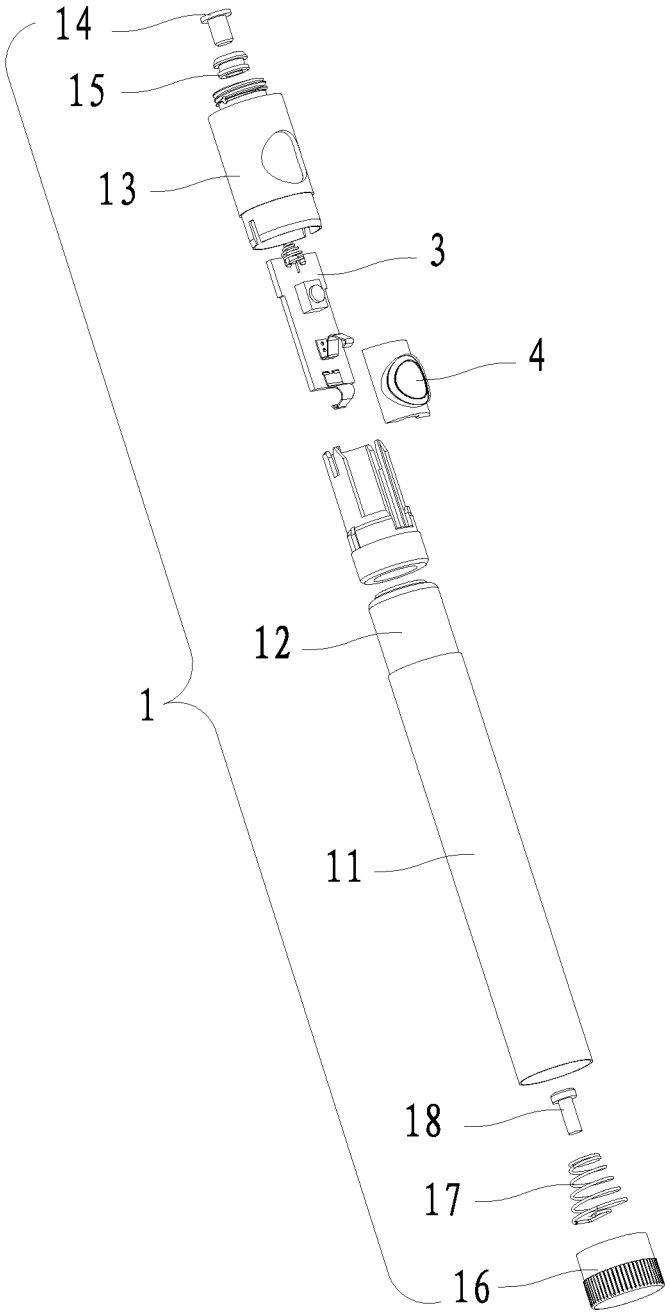
FIG. 2 is an explosive view of the electronic cigarette shown in FIG. 1 without the atomizer assembly.
Figure 3:
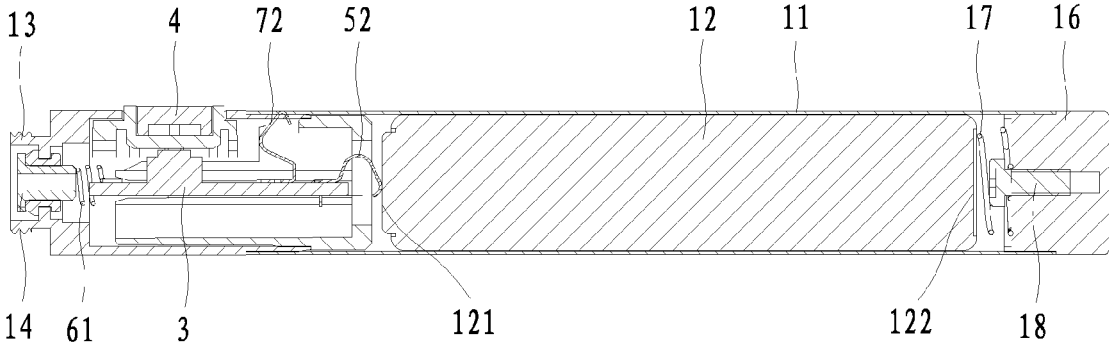
FIG. 3 is an inner structure diagram of the electronic cigarette shown in FIG. 1 without the atomizer assembly.

Referring to FIGS. 2 and 3, the battery assembly comprises a battery sleeve 11, a battery 12, a first electrode connector 13, a second electrode connector 14, an insulating member 15, an end cap 16, an elastic member 17 and a connector 18. The battery sleeve 11 is substantially a hollow cylinder. The inner wall of the battery sleeve 11 is made of conductive material. The battery 12 comprises a first electrode 121 and a second electrode 122. In the embodiment, the first electrode 121 and the second electrode 122 are settled oppositely on two opposite end faces of the battery 12. The battery 12 is installed in the battery sleeve 11. The first electrode connector 13 and the second electrode connector 14 are mounted on one end of the battery sleeve 11 respectively. The first electrode connector 13 and the second electrode connector 14 are electrically connected to the second electrode 122 and the first electrode 121 accordingly. The battery 12 is electrically connected to the atomizer assembly 2 via the first electrode connector 13 and the second electrode connector 14, and thus driving the atomizer assembly 2 to work to produce the smog that are taken in by a user. The insulating member 15 is substantially a hollow cylinder, which is installed between the first electrode connector 13 and the second electrode connector 14 in order to make the first electrode connector 13 and the second electrode connector 14 are electrically insulated.

Referring to FIG. 2, the end cap 16 is substantially a cylinder, which is made of conductive material. The end cap 16 is mounted on one end of the battery sleeve 11, wherein the end of the battery sleeve 11 is away from the first electrode connector 13. And the end cap 16 abuts against the inner wall of the battery sleeve 11 mutually. The elastic member 17 is made of metallic material. The elastic member 17 elastically abuts between the second electrode 122 and the end cap 16; in order to make the second electrode 122 and the end cap 16 connect to each other. Since the inner wall of the battery sleeve 11 is made of conductive material, the second electrode 122 is electrically connected to the inner wall of the battery sleeve 11 via the elastic member 17 and the end cap 16 successively. In the embodiment, the elastic member 17 may be a spring or an elastic piece. The connector 18 is configured to install the elastic member 17 onto the end cap 16 fixedly. The connector 18 may be a screw or the like.

Referring to FIG. 1, the atomizer assembly 2 is installed on the battery assembly 1 in a detachable way. In the embodiment, the battery assembly 1 and the atomizer assembly 2 are connected to each other by threaded connection. In other embodiments, the battery assembly 1 and the atomizer assembly 2 can be connected to each other by other detachable connection, such as buckled connection, etc. The electronic cigarette in the embodiment is a common reusable electronic cigarette.

Figure 4:
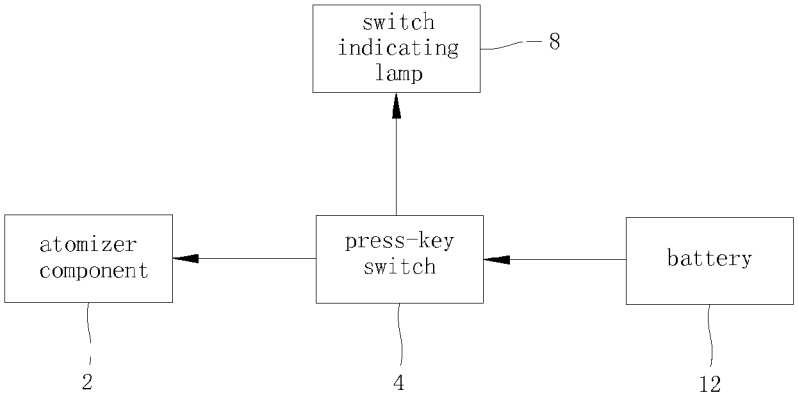
FIG. 4 is a block diagram which shows the circuit theory of the electronic cigarette shown in FIG. 1.
Figure 5:
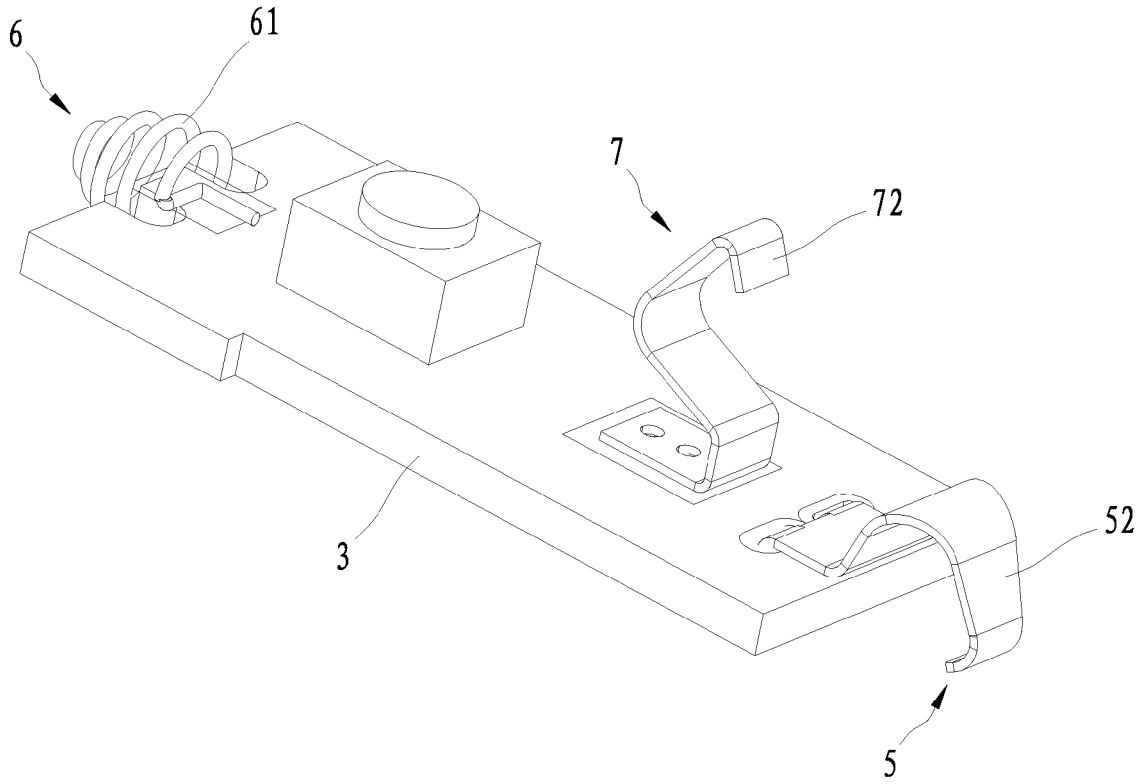
FIG. 5 is a three-dimensional structure diagram of the electronic cigarette shown in FIG. 1, in which the first, second and third elastic structure are connected to the circuit board respectively in a first embodiment.

Referring to FIGS. 3 to 5, the circuit board 3 comprises a first electrical connection fixing spot (not shown), a second electrical connection fixing spot (not shown), and a third electrical connection fixing spot (not shown). The first electrical connection fixing spot and the second electrical connection fixing spot are electrically connected to the press-key switch 4 respectively. The connection or disconnection between the first electrical connection fixing spot and the second electrical connection fixing spot can be controlled by the press-key switch 4. In the embodiment, the first electrical connection fixing spot and the second electrical connection fixing spot are located on two opposite sides of the circuit board 3. The third electrical connection fixing spot is electrically connected to the press-key switch 4 as well. The switch indicating lamp 8 is connected between the press-key switch 4 and the third electrical connection fixing spot in series. The connection or disconnection between the first electrical connection fixing spot and the switch indicating lamp 8 can be controlled by the press-key switch 4. The circuit board 3 is installed in the battery sleeve 11 and located between the battery 12 and the second electrode connector 14. The circuit board 3 is configured to control the battery 12 to power the atomizer assembly 2. The first electrical connection fixing spot is electrically connected to the first electrode 121, the second electrical connection fixing spot is electrically connected to the second electrode connector 14, and the third electrical connection fixing spot is electrically connected to the second electrode 122. In the embodiment, the circuit board 3 is a PCB board. The first electrical connection fixing spot elastically abuts the first electrode 121 via the first elastic structure 5, and the first elastic structure 5 is fixed at the first electrical connection fixing spot. The second electrical connection fixing spot elastically abuts the second electrode connector 14 via the second elastic structure 6, and the second elastic structure 6 is fixed at the second electrical connection fixing spot. The third electrical connection fixing spot elastically abuts the inner wall of the battery sleeve 11 via the third elastic structure 7, and the third elastic structure 7 is fixed at the third electrical connection fixing spot. In other embodiments, the first elastic structure 5 is connected at the first electrical connection fixing spot in a detachable way, the second elastic structure 6 is connected at the second electrical connection fixing spot in a detachable way, and the third elastic structure 7 is connected at the third electrical connection fixing spot in a detachable way. The press-key switch 4 is installed on the circuit board 3 and used to trigger the operation of the atomizer assembly 2. When the press-key switch 4 is on, the battery assembly 1 and the atomizer assembly 2 can be electrically connected via the circuit board 3, and then the atomizer assembly 2 can be driven to produce smog, at the same time the switch indicating lamp 8 is lightened. When the press-key switch 4 is off, the electrical connection between the battery assembly 1 and the atomizer assembly 2 is cut off by the circuit board 3, at the same time the switch indicating lamp 8 is turned off.

Figure 6:
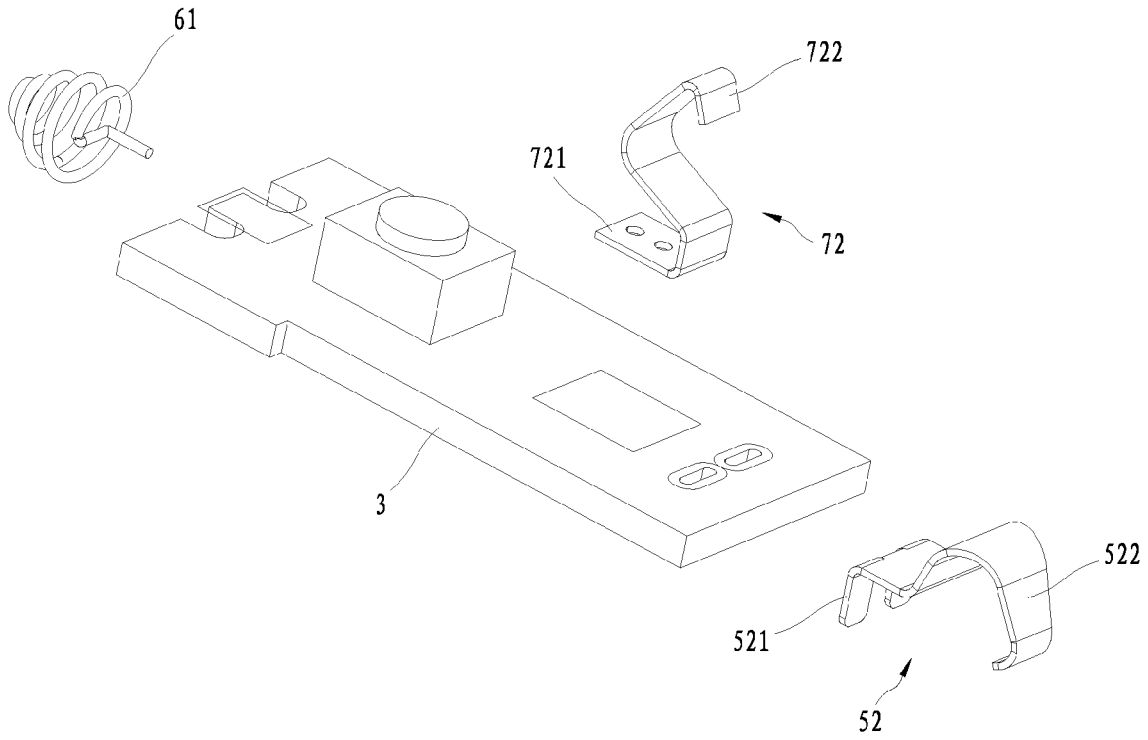
FIG. 6 is an explosive view of the first, second and third elastic structure and the circuit board shown in FIG. 5.

Referring to FIGS. 3, 5 and 6, a first embodiment when the first elastic structure 5, the second elastic structure 6 and the third elastic structure 7 are connected to the circuit board 3 respectively is shown.

The first elastic structure 5 is a first elastic piece 52. The first elastic piece 52 comprises a first fix portion 521 and a first elastic portion 522. The first fix portion 521 is substantially a slice, which is inserted in and electrically connected to the first electrical connection fixing spot. The first elastic portion 522 is substantially U-shaped, which extends from the first fix portion 521 towards the battery 12. The first elastic portion 522 abuts against the first electrode 121 mutually.

The second elastic structure 6 is a second spring 61. One end of the second spring 61 is installed at and electrically connected to the second electrical connection fixing spot, and the other end of the second spring 61 abuts against the second electrode connector 14 mutually.

The third elastic structure 7 is a third elastic piece 72. The third elastic piece 72 comprises a third fix portion 721 and a third elastic portion 722. The third fix portion is substantially a slice, which is inserted in and electrically connected to the third electrical connection fixing spot. The third elastic portion 722 is substantially U-shaped, which extends from the third fix portion 721 towards the inner wall of the battery sleeve 11. The third elastic portion 722 abuts the inner wall of the battery sleeve 11 mutually.

Figure 7:
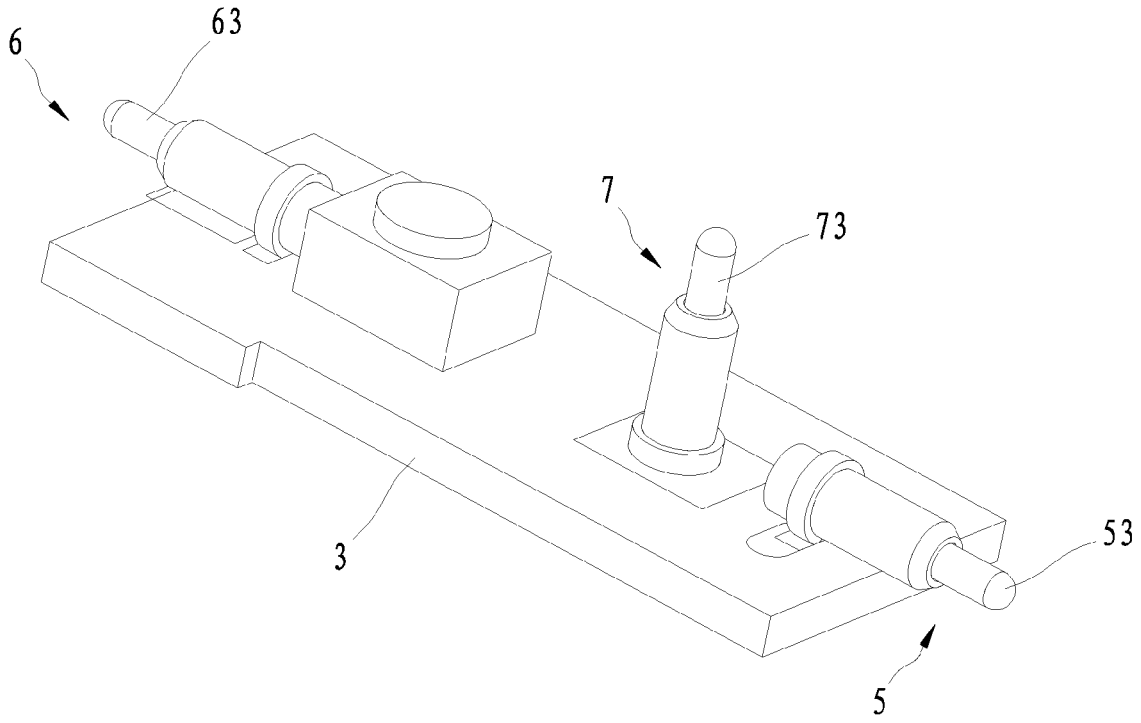
FIG. 7 is another three-dimensional structure diagram of the electronic cigarette shown in FIG. 1, in which the first, second and third elastic structure are connected to the circuit board respectively in a second embodiment.
Figure 8:
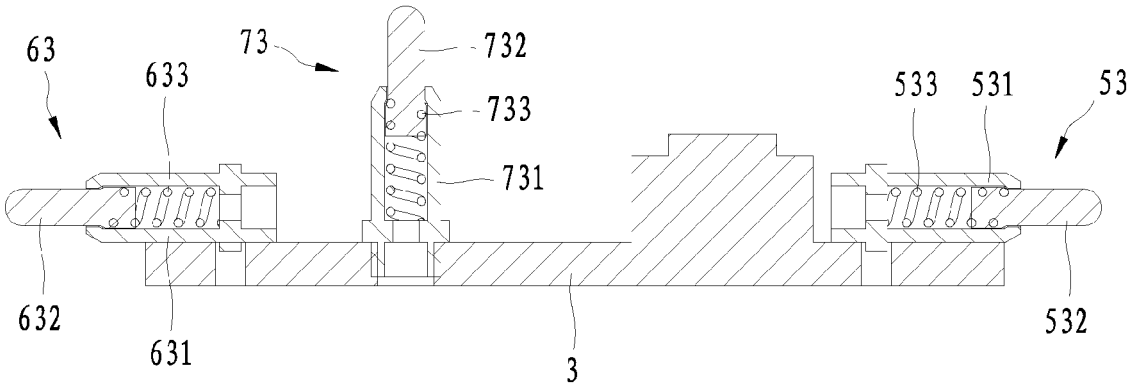
FIG. 8 is an inner structure diagram of the first, second and third elastic structure and the circuit board shown in FIG. 7.

Referring to FIGS. 3, 7 and 8, a second embodiment when the first elastic structure 5, the second elastic structure 6 and the third elastic structure 7 are connected to the circuit board 3 respectively is shown.

The first elastic structure 5 is a first telescopic device 53. The first telescopic device 53 comprises a first mount base 531, a first telescopic bar 532 and a first elastic member 533. The first mount base 531 is substantially a hollow cylinder, which is installed at and electrically connected to the first electrical connection fixing spot. The first telescopic bar 532 is substantially a round bar, which is settled in the first mount base 531 in a telescopic way. And the first telescopic rod 532 abuts against the first electrode 121 mutually. The first elastic member 533 is elastically supported between the first mount base 531 and the first telescopic bar 532, and the first elastic member 533 may be a spring and the like.

The second elastic structure 6 is a second telescopic device 63. The second telescopic device 63 comprises a second mount base 631, a second telescopic bar 632 and a second elastic member 633. The second mount base 631 is substantially a hollow cylinder as well, which is installed at and electrically connected to the second electrical connection fixing spot. The second telescopic bar 632 is substantially a round bar, which is settled in the second mount base 631 in a telescopic way. And the second telescopic bar 632 abuts against the second electrode connector 14 mutually. The second elastic member 633 is elastically supported between the second mount base 631 and the second telescopic bar 632, and the second elastic member 633 may be a spring and the like.

The third elastic structure 7 is a third telescopic device 73. The third flexible device 73 comprises a third mount base 731, a third telescopic bar 732 and a third elastic member 733. The third mount base 731 is substantially a hollow cylinder as well, which is installed at and electrically connected to the third electrical connection fixing spot. The third telescopic bar 732 is substantially a round bar, which is settled in the third mount base 731 in a telescopic way. And the third telescopic bar 732 abuts against the inner wall of the battery sleeve 11 mutually. The third elastic member 733 is elastically supported between the third mount base 731 and the third telescopic bar 732, and the third elastic member 733 may be a spring and the like.

Figure 9:
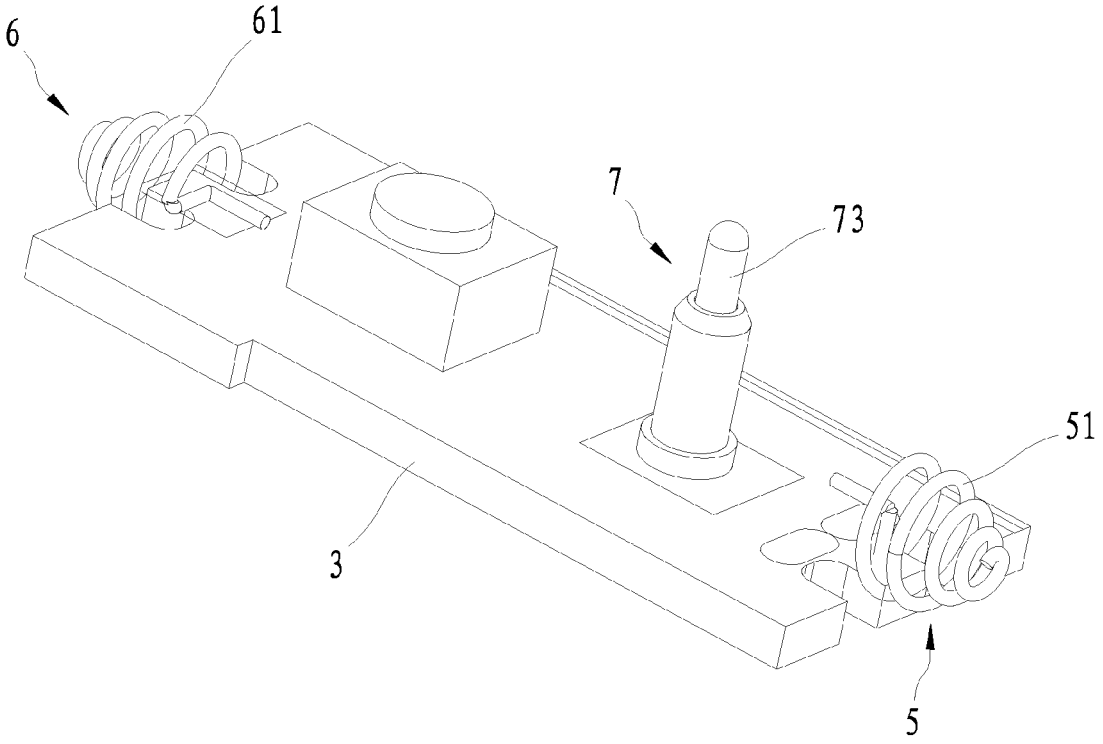
FIG. 9 is another three-dimensional structure diagram of the electronic cigarette shown in FIG. 1, in which the first, second and third elastic structure are connected to the circuit board respectively in a third embodiment.

Referring to FIGS. 3 and 9, a third embodiment when the first elastic structure 5, the second elastic structure 6 and the third elastic structure 7 are connected to the circuit board 3 respectively is shown.

The first elastic structure 5 is a first spring 51. One end of the first spring 51 is electrically connected to the first electrical connection fixing spot, and the other end of the first spring 51 abuts against the first electrode 121 mutually. The second elastic structure 6 is the second spring 61 described above. The third elastic structure 7 is the third telescopic device 73 described above.

In other embodiments, the second elastic structure 6 may be a second elastic piece (not shown). The second elastic piece comprises a second fix portion and a second elastic portion. The second fix portion is substantially a slice, which is inserted in and electrically connected to the second electrical connection fixing spot. The second elastic portion is substantially U-shaped, which extends from the second fix portion towards the second electrode connector 14. The second elastic portion abuts against the second electrode connector 14 mutually. The third elastic structure 7 may be a third spring (not shown). One end of the third spring is installed at and electrically connected to the third electrical connection fixing spot, and the other end of the third spring abuts against the inner wall of the battery sleeve 11 mutually. The above configurations of the first elastic structure 5, the second elastic structure 6 and the third elastic structure 7 can be combined randomly according to above embodiments.

In the embodiment, the first electrical connection fixing spot elastically abuts the first electrode 121 via the first elastic structure 5, the second electrical connection fixing spot elastically abuts the second electrode connector 14 via the second elastic structure 6, and the third electrical connection fixing spot elastically abuts the inner wall of the battery sleeve 11 via the third elastic structure 7. In other embodiments, only one or two of the first electrical connection fixing spot, the second electrical connection fixing spot and the third electrical connection fixing spot elastically abuts or abut the corresponding structure in the battery assembly 1. With above structures, the assembling process for the electronic cigarette can be simple and convenient, and thus benefiting for the automated assembling production.

Figure 10:
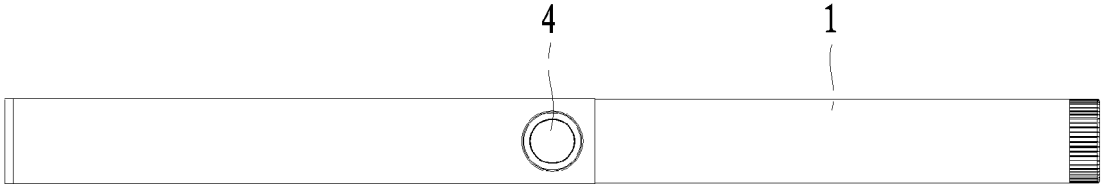
FIG. 10 is a structure diagram of an electronic cigarette in a second preferred embodiment of the present application.

Referring to FIG. 10, a second preferred embodiment of an electronic cigarette is shown. Compared with the first preferred embodiment, in the second preferred embodiment, the connection structure between the battery assembly 1 and the atomizer assembly 2 is different. In this embodiment, the battery sleeve 11 and the atomizer sleeve in the atomizer assembly 2 are formed integrally. The electronic cigarette in the present embodiment is a common one-off electronic cigarette.

While the embodiments of the present application have been described with reference to the drawings, the present application will not be limited to above embodiments that are illustrative but not limitative. It will be understood by those skilled in the art that various changes and equivalents may be substituted in the light of the present application without departing from the scope of the present application, and those various changes and equivalents shall fall into the protection of the application.

What is claimed is:

1. An electronic cigarette, which comprises a battery assembly with a battery built in, an atomizer assembly, a circuit board for controlling the battery assembly to power the atomizer assembly, and a press-key switch installed on the circuit board, the battery comprising a first electrode and a second electrode;

wherein a first electrical connection fixing spot, a second electrical connection fixing spot and a third electrical connection fixing spot are provided on the circuit board and are electrically connected to the press-key switch respectively;

wherein the battery assembly comprises a battery sleeve, the battery being installed in the battery sleeve, and a first electrode connector and a second electrode connector which are installed on one end of the battery sleeve, an insulating member is installed between the first electrode connector and the second electrode connector in order to make the first electrode connector and the second electrode connector be electrically insulated;

wherein inner wall of the battery sleeve is made of conductive material;

wherein the first electrical connection fixing spot is fixed with a first elastic structure, and the first elastic structure elastically abuts against the first electrode of the battery, the first electrical connection fixing spot is electrically connected to the first electrode;

wherein the second electrical connection fixing spot is fixed with a second elastic structure, and the second elastic structure elastically abuts against the second electrode connector, the second electrical connection fixing spot is electrically connected to the second electrode connector;

wherein the third electrical connection fixing spot is fixed with a third elastic structure, and the third elastic structure elastically abuts against the inner wall of the battery sleeve; the inner wall of the battery sleeve is electrically connected to the second electrode, the third electrical connection fixing spot is electrically connected to the second electrode;

wherein the battery assembly further comprises an end cap being made of conductive material and an elastic member; the end cap is mounted on one end of the battery sleeve, wherein the end of the battery sleeve is away from the first electrode connector; the elastic member elastically abuts between the second electrode and the end cap; the second electrode is electrically connected to the inner wall of the battery sleeve via the elastic member and the end cap successively; and wherein the press-key switch is configured to trigger operation of the atomizer assembly, when the press-key switch is on, the battery assembly and the atomizer assembly being electrically connected via the circuit board, and then the atomizer assembly can be driven to produce smog;

wherein the atomizer assembly is installed on the battery assembly in a detachable way; the circuit board is installed in the battery sleeve and located between the battery and the second electrode connector; the first electrode connector is electrically connected to the second electrode of the battery; a switch indicating lamp is connected between the press-key switch and the third electrical connection fixing spot in series;

wherein the first elastic structure is a first elastic piece; the first elastic piece comprises a first fix portion inserted in the first electrical connection fixing spot and a first elastic portion extending from the first fix portion towards the battery; the first fix portion is a slice and the first elastic portion is U-shaped, the first elastic portion abuts against the first electrode mutually;

wherein the second elastic structure is a second elastic piece; the second elastic piece comprises a second fix portion inserted in the second electrical connection fixing spot and a second elastic portion extending from the second fix portion towards the second electrode connector; the second fix portion is a slice and the second elastic portion is U-shaped, the second elastic portion abuts against the second electrode connector mutually;

wherein the third elastic structure is a third elastic piece; the third elastic piece comprises a third fix portion inserted in the third electrical connection fixing spot, and a third elastic portion extending from the third fix portion towards the inner wall of the battery sleeve; the third fix portion is a slice and the third elastic portion is U-shaped, the third elastic portion abuts against the inner wall of the battery sleeve mutually.

2. An electronic cigarette, which comprises a battery assembly with a battery built in, an atomizer assembly, a circuit board for controlling the battery assembly to power the atomizer assembly, and a press-key switch installed on the circuit board, the battery comprising a first electrode and a second electrode;

wherein a first electrical connection fixing spot, a second electrical connection fixing spot and a third electrical connection fixing spot are provided on the circuit board and are electrically connected to the press-key switch respectively;

wherein the battery assembly comprises a battery sleeve, the battery being installed in the battery sleeve, and a first electrode connector and a second electrode connector which are installed on one end of the battery sleeve, an insulating member is installed between the first electrode connector and the second electrode connector in order to make the first electrode connector and the second electrode connector be electrically insulated;

wherein inner wall of the battery sleeve is made of conductive material;

wherein the first electrical connection fixing spot is fixed with a first elastic structure, and the first elastic structure elastically abuts against the first electrode of the battery, the first electrical connection fixing spot is electrically connected to the first electrode;

wherein the second electrical connection fixing spot is fixed with a second elastic structure, and the second elastic structure elastically abuts against the second electrode connector, the second electrical connection fixing spot is electrically connected to the second electrode connector;

wherein the third electrical connection fixing spot is fixed with a third elastic structure, and the third elastic structure elastically abuts against the inner wall of the battery sleeve; the inner wall of the battery sleeve is electrically connected to the second electrode, the third electrical connection fixing spot is electrically connected to the second electrode;

wherein the battery assembly further comprises an end cap being made of conductive material and an elastic member; the end cap is mounted on one end of the battery sleeve, wherein the end of the battery sleeve is away from the first electrode connector; the elastic member elastically abuts between the second electrode and the end cap; the second electrode is electrically connected to the inner wall of the battery sleeve via the elastic member and the end cap successively; and wherein the press-key switch is configured to trigger operation of the atomizer assembly, when the press-key switch is on, the battery assembly and the atomizer assembly being electrically connected via the circuit board, and then the atomizer assembly can be driven to produce smog;

wherein the atomizer assembly is installed on the battery assembly in a detachable way; the circuit board is installed in the battery sleeve and located between the battery and the second electrode connector; the first electrode connector is electrically connected to the second electrode of the battery; a switch indicating lamp is connected between the press-key switch and the third electrical connection fixing spot in series;

wherein the first elastic structure is a first elastic piece; the first elastic piece comprises a first fix portion and a first elastic portion, the first fix portion is a slice, which is inserted and electrically connected to the first electrical connection fixing spot, the first elastic portion is substantially U-shaped, which extends from the first fix portion towards the battery, and the first elastic portion abuts against the first electrode mutually;

wherein the second elastic structure is a second spring; one end of the second spring is electrically connected to the second electrical connection fixing spot, and the other end of the second spring abuts against the second electrode connector mutually;

wherein the third elastic structure is a third elastic piece; the third elastic piece comprises a third fix portion and a third elastic portion, the third fix portion is a slice, which is inserted and electrically connected to the third electrical connection fixing spot, the third elastic portion is substantially U-shaped, which extends from the third fix portion an inner wall of the battery sleeve, and the third elastic portion abuts against the inner wall of the battery sleeve mutually.

* * * * *